US006028047A

United States Patent [19]

Nestler

[11] Patent Number: 6,028,047

[45] Date of Patent: Feb. 22, 2000

[54] USE OF FORMAMIDINIUM SALTS AS BLEACH ACTIVATORS

[75] Inventor: Bernd Nestler, Frankfurt, Germany

[73] Assignee: Clariant GmbH, Frankfurt, Germany

[21] Appl. No.: 09/229,204

[22] Filed: Jan. 13, 1999

[30] Foreign Application Priority Data

Jan. 14, 1998 [DE] Germany ..... 198 01 049

[51] Int. Cl.[7] ..... D06L 3/10

[52] U.S. Cl. ..... 510/376; 510/314

[58] Field of Search ..... 510/314, 376

[56] References Cited

U.S. PATENT DOCUMENTS 4,451,384 5/1984 Malafosse ..... 252/102
5,549,715 8/1996 Olip ..... 8/110

FOREIGN PATENT DOCUMENTS 0098129 1/1984 European Pat. Off. .
0120591 10/1984 European Pat. Off. .
836988 6/1960 United Kingdom .
907356 10/1962 United Kingdom .

OTHER PUBLICATIONS

Houben–Weyl, Bd. E4 (1983), S. 671–677.

*Primary Examiner*—Yogendra Gupta
*Assistant Examiner*—John R. Hardee
*Attorney, Agent, or Firm*—Miles B. Dearth

[57] ABSTRACT

The invention relates to the use of compounds of the formula

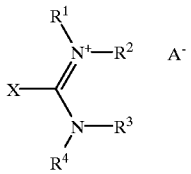

as bleach activators in detergents and cleaners, where $R^1$, $R^2$, $R^3$ and $R^4$, X and A are as defined in the description.

7 Claims, No Drawings

USE OF FORMAMIDINIUM SALTS AS BLEACH ACTIVATORS

DESCRIPTION

Use of formamidinium salts as bleach activators

This invention relates to the use of formamidinium salts as bleach activators and to detergent compositions comprising these compounds as bleach activators.

It is known that the bleaching power of peroxidic bleaches, such as perborates, percarbonates, persilicates and perphosphates, can be improved so that the bleaching action starts at relatively low temperatures, for example at or below 60° C., by adding the precursors of bleaching peroxy acids, which are often referred to as bleach activators.

Many substances are known bleach activators in the prior art. They are usually reactive organic compounds containing a O-acyl or N-acyl group which, in alkaline solution together with a source of hydrogen peroxide, form the corresponding peroxy acids.

Representative examples of bleach activators are, for example, N,N,N,N-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglucolurile (TAGU), tetraacetylcyanic acid (TACA), di-N-acetyldimethoxyglyoxine (ADMG) and 1-phenyl-3-acetylhydantoin (PAH). Reference may be made, for example, to GB-A-836 988, GB-A-907 356, EP-A-0 098 129 and EP-A-0 120 591.

Another group of bleach activators are amidines and salts derived therefrom, of the formula

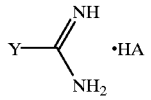

where Y is a halogen atom, and HA is an inorganic or organic acid. The use of such amine derivatives as bleach activators in detergents and cleaners is described, for example, in U.S. Pat. No. 4,451,384. A disadvantage with using these compounds as bleach activators, however, is the severe color and fiber damage to the washed article.

Surprisingly, it has now been found that formamidinium salts on the one hand have very good bleaching activity, but on the other hand do not cause color and fiber damage; this represents a distinct advantage over the prior art. The described compounds are also present as a pure substance in the form of colorless, readily water-soluble solids, as a result of which they are particularly easy to handle.

The invention provides for the use of formamidinium salts of the formula

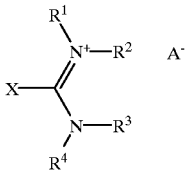

as bleach activators, where $R^1$, $R^2$, $R^3$ and $R^4$ independently of one another are $C_1$–$C_{24}$-alkyl, $C_2$–$C_{24}$-alkenyl, $C_1$–$C_{24}$-hydroxyalkyl, $C_2$–$C_{24}$-chloroalkyl, $C_1$–$C_{24}$-aminoalkyl, aryl, $C_1$–$C_4$-alkylaryl or $C_1$–$C_4$-alkoxy-$C_1$–$C_4$-alkyl, $R^1$ and $R^2$ and/or $R^3$ and $R^4$ together with the nitrogen atom to which they are bonded, or $R^1$ and $R^3$ or $R^2$ and $R^4$ together with the nitrogen atom to which they are bonded, and the carbon atom between these nitrogen atoms may in each case form four- to nine-membered rings which, instead of $CH_2$ groups, may also contain —O—, —S—, —NH—or >C=O groups in the ring, and may be substituted by halogen, hydroxyl, carboxyl, amino or carboxamido groups, X is fluorine, chlorine or bromine, and A is an anion.

Preferably, $R^1$, $R^2$, $R^3$ and $R^4$ independently of one another are $C_1$–$C_4$-alkyl, $C_2$–$C_4$-alkenyl, phenyl, or $R^1$ and $R^2$ and/or $R^3$ and $R^4$ together with the nitrogen atom to which they are bonded, form a five-, six- or seven-membered ring, or $R^1$ and $R^3$ or $R^2$ and $R^4$ together with the nitrogen atom to which they are bonded and the carbon atom between these nitrogen atoms form a five-, six- or seven-membered ring.

Examples of suitable anions A are chloride, bromide, iodide, fluoride, sulfate, hydrogensulfate, carbonate, hydrogencarbonate, phosphate, monohydrogenphosphate and dihydrogenphosphate, pyrophosphate, metaphosphate, hexafluorophosphate, nitrate, methosulfate, dodecylsulfate, dodecylbenzenesulfonate, tosylate, phosphonate, methylphosphonate, methanedisulfonate, methylsulfonate, ethanesulfonate, formate, acetate or propionate.

The formamidinium salts are readily available by a simple route by reacting urea derivatives with suitable halogenating agents, such as, for example, phosgene, oxalyl chloride, phosphorus pentachloride and trichloride, phosphorus oxychloride, and the corresponding bromides; such reactions are described, for example, in A. Marhold "Kohlens äurederivate" [Carbonic acid derivatives], Methoden der Organischen Chemie [Methods in organic chemistry] (Houben-Weyl), H. Hagemann (ed.), Vol. E 4 (1983), p. 671–677 and the literature cited therein.

The invention also provides bleaching detergents and cleaners containing formamidinium salts as defined above. In addition to a peroxy compound and the bleach activator, these detergents and cleaners usually also comprise surface-active compounds and other ingredients.

Suitable peroxy compounds are alkali metal peroxides, organic peroxides, such as urea peroxide, and inorganic persalts, such as alkali metal perborates, percarbonates, perphosphates, persilicates and persulfates. Mixtures of two or more of these compounds are also suitable. Particular preference is given to sodium perborate tetrahydrate and, in particular, sodium perborate monohydrate.

Due to its long shelf life and its good solubility in water, sodium perborate monohydrate is preferred. Sodium percarbonate may be preferred because of environment-protection reasons. Alkali hydroperoxides are another suitable group of peroxy compounds. Examples of these substances are cumene hydroperoxide and t-butyl hydroperoxide.

Such detergents and cleaners can comprise the bleach activator according to the invention in an amount by weight of from about 0.05 to 20%, preferably from 0.5 to 10%, in particular from 1 to 7.5%, together with a peroxy compound. The amount by weight of these peroxy compounds is usually from 1% to 60%, preferably from 4 to 30%, in particular from 10 to 25%.

As well as the bleach activators according to the invention, the detergent and cleaners may also comprise other suitable bleach activators, such as, for example, TAED, tetraacetylglycolurile, glucose pentaacetate, sodium nonanoyloxybenzenesulfonate, benzenecaprolactam or nitrilic activators in an amount of from 1 to 10% by weight.

The surface-active compounds can be derived from natural products, such as, for example, soaps, or are a synthetic compound from the group consisting of anionic, nonionic, amphoteric, zwitterionic or cationic surface-active substances, or mixtures thereof. Many suitable substances are available commercially, and are described in the literature, for example in "Surface active agents and detergents", Vol. 1 and 2, by Schwartz, Perry and Berch. A total amount of surface-active compounds can be up to 50% by weight, preferably from 1% by weight to 40% by weight, in particular from 4% by weight to 25% by weight.

Suitable synthetic anionic surface-active substances are alkali metal salts of organic sulfates and sulfonates containing alkyl radicals having from about 8 to 22 carbon atoms, the term "alkyl" including the alkyl substituents of higher aryl radicals.

Examples of such sulfates and sulfonates are sodium and ammonium alkylsulfates, specifically the sulfates obtained by sulfation of higher ($C_8$ to $C_{18}$) alcohols; sodium and ammonium alkylbenzenesulfonates containing alkyl radicals from $C_9$ to $C_{20}$, in particular linear secondary sodium alkylbenzenesulfonates containing an alkyl radical from $C_{10}$ to $C_{15}$; sodium alkylglyceryl ether sulfates, particularly the esters of higher alcohols derived from taro oil and coconut oil; the sodium sulfates and sodium sulfonates of coconut fatty acid monoglycerides, sodium and ammonium salts of the sulfuric esters of higher ($C_9$ to $C_{18}$) oxalkylated fatty alcohols, in particular those oxalkylated with ethylene oxide; the reaction products of the esterification of fatty acids with isethionic acid and subsequent neutralization with sodium hydroxide; sodium and ammonium salts of fatty acid amides of methyltaurin; alkanemonosulfonates such as those from the reaction of olefins ($C_8$ to $C_{20}$) with sodium bisulfite and those from the reaction of paraffins with $SO_2$ and $Cl_2$ with subsequent basic hydrolysis, a mixture of different sulfonates being produced; sodium and ammonium dialkylsulfosuccinates containing alkyl radicals from $C_7$ to $C_{12}$, and olefinsulfonates produced in the reaction of olefins, in particular $C_{10}$–$C_{20}$-olefins, with $SO_3$ and subsequent hydrolysis of the reaction product. The preferred anionic detergents are sodium alkylbenzenesulfonates containing alkyl radicals from $C_{15}$–$C_{18}$, and sodium alkyl ether sulfates containing alkyl radicals from $C_{16}$ to $C_{18}$.

Examples of suitable nonionic surface-active compounds, which are preferably used together with anionic surface-active compounds, are, in particular, the reaction products of alkylene oxides (usually ethylene oxide) with alkylphenols (alkyl radicals from $C_5$ to $C_{22}$), the reaction products generally containing from 5 to 25 ethylene oxide (EO) units in the molecule, the reaction products or aliphatic ($C_8$–$C_{18}$) primary or secondary, linear or branched alcohols with ethylene oxide, containing, in general, from 6 to 30 EO, and the addition products of ethylene oxide with reaction products of propylene oxide and ethylenediamine. Other nonionic surface-active compounds are alkyl polyglycosides, long-chain tertiary amine oxides, long-chain tertiary phosphine oxides and dialkyl sulfoxides.

Amphoteric or zwitterionic surface-active compounds can also be used in the compositions according to the invention, although ir most cases this is not preferable due to their high costs. If amphoteric or zwitterionic compounds are used, then it is generally in small amounts in compositions which principally comprise anionic and nonionic surfactants.

It is also possible to use soaps in the compositions according to the invention, preferably in an amount of less 25% by weight. They are particularly suitable in small amounts in binary (soap/anionic surfactant) or in ternary mixtures together with nonionic or mixed synthetic anionic and nonionic surfactants. The soaps used are preferably the sodium salts, and less preferably the potassium salts, of saturated or unsaturated $C_{10}$–$C_{24}$ fatty acids or mixtures thereof. The amounts of such soaps can be from 0.5 to 25% by weight, lower amounts of from 0.5 to 5% by weight generally sufficing for foam control. Soap contents between 2 and about 20%, particularly between about 5 and about 10%, have a positive effect. This is the case particularly in hard water, where the soap serves as an additional builder substance.

The detergents and cleaners generally also comprise a builder. Suitable builders are: calcium-binding substances, precipitants, calcium-specific ion exchangers and mixtures thereof. Examples of calcium-binding substances include alkali metal polyphosphates, such as sodium polyphosphate, nitrilotriacetic acid and its water-soluble salts, the alkali metal salts of carboxymethoxysuccinic acid, ethylenediaminetetraacetic acid, oxydisuccinic acid, mellitic acid, benzenepolycarboxylic acids, citric acid and polyacetal carboxylates, as disclosed in U.S. Pat. No. 4,144,226 and U.S. Pat. No. 4,146,495.

Examples of precipitants are sodium orthophosphate, sodium carbonate and soaps of long-chain fatty acids.

Examples of ion exchangers which are specific for calcium are the various types of water-insoluble, crystalline or amorphous aluminum silicates, of which the zeolites are the best-known examples.

These builder substances can be present in amounts of from 5 to 80% by weight, an amount of from 10 to 60% by weight being preferable.

In addition to the ingredients already mentioned, the detergents and cleaners may comprise any of the conventional additives in amounts which are usually found in such compositions. Examples of these additives include foam formers, such as, for example, alkanolamides, particularly the monoethanolamides from palm kernel oil fatty acids and coconut fatty acids, antifoams, such as, for example, alkyl phosphates and alkylsilicones, antiredeposition agents and similar auxiliaries, such as, for example, sodium carboxymethylcellulose and alkyl or substituted alkyl cellulose ethers, stabilizers, such as ethylenediaminetetraacetic acid, softeners for textiles, inorganic salts, such as sodium sulfate, and, in customarily small amounts, fluorescent substances, perfumes, enzymes, such as proteases, cellulases, lipases and amylases, disinfectants and dyes. The bleach activators of this invention can be used in a large number of products. These include textile detergents, textile bleaches, surface cleaners, toilet cleaners, machine dishwashing detergents and also denture cleaners. The detergents can be in solid form or liquid form.

For reasons of stability and handleability, it is advantageous to use the bleach activators in the form of granules which, in addition to the bleach activator, comprise a binder. Various methods of producing such granules are described in the patent literature, for example in CA-1 102 966, GB-1 561 33, U.S. Pat. No. 4,087,369, EP-A-0 240 057, EP-A-0 241 962, EP-A-0 101 634 and EP-A-0 062 523. Any of these methods can be used for the bleach activators according to the invention.

The granules comprising the bleach activators are generally added to the detergent composition together with other, dry constituents, such as, for example, enzymes or inorganic peroxide bleaches. The detergent composition to which the activator granules are added can be obtained in various ways, such as, for example, by dry mixing, extruding and spray drying.

In another embodiment, the bleach activators according to the invention are particularly suitable for nonaqueous liquid detergents, together with a bleaching peroxy compound, for example sodium perborate, for giving the detergent a high level of detergency for fabrics and textiles. Such nonaqueous, liquid detergents, which include pasty and gelatinous detergent compositions, are known in the prior art, and are described, for example, in U.S. Pat. No. 2,864,770, U.S. Pat. No. 2,940,938, U.S. Pat. No. 4,772,412, U.S. Pat. No. 3,368,977, GB-A-1 205 711, GB-A-1 370 377, GB-A-1 270 040, GB-A-1 292 352, GB-A-2 194 536, DE-A-2 233 771 and EP-A-0 028 849.

These compositions are in the form of a nonaqueous, liquid medium in which a solid phase can be dispersed. The nonaqueous, liquid medium can be a liquid surface-active substance, preferably a nonionic surface-active substance, a non-polar liquid medium, such as, for example, liquid paraffin, a polar solvent, such as, for example, polyols, for example, glycerol, sorbitol, ethylene glycol, possibly in combination with low molecular weight monohydric alcohols such as ethanol or isopropanol, or mixtures thereof.

The solid phase can consist of builder substances, alkalis, abrasive substances, polymers, other solid ionic surface-active substances, bleaches, fluorescent substances and other customary solid ingredients.

The aim of the examples below, which are not exhaustive, is to give an overview of the embodiments of the invention.

EXAMPLES 200 ml of an aqueous solution of the reference detergent WMP (Laundry Research, Krefeld, 5 g/l in water of German hardness 15°), 150 mg of sodium perborate monohydrate and 50 mg of the particular activator were mixed to prepare a bleach composition. Using this composition, swatches of fabric soiled with the standard soiling BC-1 tea (on cotton, Laundry Research, Krefeld) were subjected to a treatment at a temperature of 40° C. under isothermal washing conditions in a Linitest apparatus (Heraeus). After a washing time of 30 minutes, the swatches of fabric were rinsed with water, dried and ironed. The bleaching action was then quantified by determining the differences $\Delta R_{(ACT)}$ in the reflectances before and after bleaching using an ELREPHO 2000 whiteness measuring device (Datacolor). These $\Delta R_{(ACT)}$ values and the $\Delta R_O$ values determined in the control experiments without bleach activator were used to calculate the $\Delta\Delta R$ values listed in Table 1, which are a direct measure of the improvement in bleaching action caused by the addition of activator:

$$\Delta\Delta R=\Delta R_{(ACT)}-\Delta R_O$$

Corresponding comparative experiments were carried out in which 50 mg of tetraacetylethylenediamine (TAED) were in each case additionally added to the abovementioned bleach composition. The $\Delta R_{(ACT/TAED)}$ values determined in this case and the $\Delta R_{O(TAED)}$ values obtained in control experiments exclusively with the addition of TAED were used to determine $\Delta\Delta R_{(TAED)}$ values. These values, which are shown in Table 1, indicate the improvement in the bleaching action as a result of an addition of the bleach activators according to the invention to a bleach composition comprising TAED:

$$\Delta\Delta R_{(TAED)}=\Delta R_{(ACT/TAED)}-\Delta R_{O(TAED)}$$

The Compounds 1 and 2 are:

1

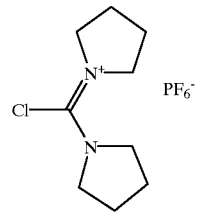

2

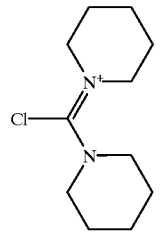

TABLE 1

| | 1 | 2 |
|---|---|---|
| $\Delta\Delta R$ | 7.9 | 5.3 |
| $\Delta\Delta R_{(TAED)}$ | 6.7 | 4.8 |

The washing experiments show that the formamidinium salts according to the invention have very good bleaching activity and in this respect surpass the standard commercial bleach activator TAED. Other properties of the complexes described are low color damage and low fiber damage.

I claim:

1. A detergent or cleaner comprising a) from 1 to 60% by weight of a peroxy compound, and b) from 0.05 to 20% by weight of a formamidinium salt of the formula

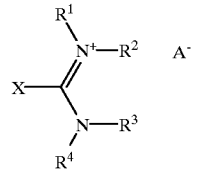

where $R^1$, $R^2$, $R^3$ and $R^4$ independently of one another are $C_1$–$C_{24}$-alkyl, $C_2$–$C_{24}$-alkenyl, $C_1$–$C_{24}$-hydroxyalkyl, $C_2$–$C_{24}$-chloroalkyl, $C_1$–$C_{24}$-aminoalkyl, aryl, $C_1$–$C_4$-alkylaryl or $C_1$–$C_4$-alkoxy-$C_1$–$C_4$-alkyl, $R^1$ and $R^2$ and/or $R^3$ and $R^4$ together with the nitrogen atom to which they are bonded, or $R^1$ and $R^3$ or $R^2$ and $R^4$ together with the nitrogen atom to which they are bonded, and the carbon atom between these nitrogen atoms may in each case form four- to nine-membered rings which, instead of $CH_2$ groups, may also contain —O—, —S—, —NH—, or >C═O groups in the ring, and may be substituted by halogen, hydroxyl, carboxyl, amino or carboxamido groups, X is fluorine, chlorine or bromine, and A is an anion.

2. The detergent or cleaner as claimed in claim 1, wherein the peroxy compound is perborate, percarbonate, perphosphate, persilicate, monopersulfate or urea peroxide.

3. The detergent or cleaner as claimed in claim 1, which comprises up to 50% by weight of a surface-active compound.

4. The detergent or cleaner as claimed in claim 1, which comprises builders in an amount of from 5 to 80% by weight.

5. The detergent or cleaner as claimed in claim 4, which comprises further bleach activators and/or bleach catalysts.

6. The detergent or cleaner of claim 4 wherein where $R^1$, $R^2$, $R^3$ and $R^4$ independently of one another are $C_1$–$C_4$-alkyl, $C_2$–$C_4$-alkenyl, said aryl group is a phenyl group, or $R^1$ and $R^3$ or $R^2$ and $R^4$ together with the nitrogen atom to which they are bonded, and the carbon atom between these nitrogen atoms may in each case form four- to nine-membered rings which, instead of $CH_2$ groups, may also contain —O—, —S—, —NH—, or >C═O groups in the ring, and may be substituted by halogen, hydroxyl, carboxyl, amino or carboxamido groups.

7. The detergent or cleaner of claim 1, where A— is chloride, bromide, iodide, fluoride, sulfate, hydrogensulfate, carbonate, hydrogencarbonate, pyrophosphate, metaphosphate, hexafluorophosphate, nitrate, methosulfate, dodecylsulfate, dodecylbenzenesulfonate, tosylate, phosphonate, methylphosphonate, methanedisulfonate, methylsulfonate, ethanesulfonate, formate, acetate, or propionate.

* * * * *